US006793988B2

(12) United States Patent
Takeuchi et al.

(10) Patent No.: US 6,793,988 B2
(45) Date of Patent: Sep. 21, 2004

(54) INK RIBBON FOR IMAGE TRANSCRIPTION

(75) Inventors: Hiroshi Takeuchi, Kanagawa (JP); Yoshihiro Okamoto, Kanagawa (JP); Hidehiko Funayama, Kanagawa (JP); Seijiro Tomita, Tokyo (JP); Satoshi Nakamura, Kanagawa (JP); Mitsuaki Ogiwara, Gifu (JP); Kohji Ogiwara, Gifu (JP)

(73) Assignee: Sony Corporation (JP)

( * ) Notice: Subject to any disclaimer, the term of this patent is extended or adjusted under 35 U.S.C. 154(b) by 29 days.

(21) Appl. No.: 10/190,720

(22) Filed: Jul. 9, 2002

(65) Prior Publication Data

US 2003/0003279 A1 Jan. 2, 2003

Related U.S. Application Data

(62) Division of application No. 08/617,882, filed as application No. PCT/JP95/01480 on Jul. 25, 1995, now Pat. No. 6,417,138.

(30) Foreign Application Priority Data

Jan. 24, 1994 (JP) ..... P7-008797
Jul. 26, 1994 (JP) ..... P6-174195

(51) Int. Cl.[7] ..... B41M 5/40
(52) U.S. Cl. ..... 428/32.76; 428/32.81
(58) Field of Search ..... 428/32.76, 32.81; 503/227

(56) References Cited

U.S. PATENT DOCUMENTS

| | | | | |
|---|---|---|---|---|
| 4,522,881 A | | 6/1985 | Kobayashi et al. | |
| 4,738,555 A | * | 4/1988 | Nagashima | 400/240 |
| 4,993,987 A | | 2/1991 | Hull | |
| 5,246,518 A | | 9/1993 | Hale | |
| 5,286,706 A | | 2/1994 | Mochizuki | |
| 5,643,387 A | | 7/1997 | Berghauser | |

FOREIGN PATENT DOCUMENTS

| | | |
|---|---|---|
| DE | 40 11 215 | 10/1990 |
| EP | 0 227 092 | 7/1987 |
| EP | 0 350 534 | 1/1990 |
| EP | 0 474 355 | 3/1992 |
| EP | 0 514 631 | 11/1992 |
| EP | 0 587 148 | 3/1994 |
| EP | 0 672 542 | 9/1995 |
| JP | 47-51734 | 12/1972 |
| JP | 60-73899 | 4/1985 |
| JP | 61-573927 | 3/1986 |

(List continued on next page.)

*Primary Examiner*—B. Hamilton Hess
(74) *Attorney, Agent, or Firm*—Rader, Fishman & Grauer PLLC; Ronald P. Kananen

(57) ABSTRACT

An image transcription method of transcribing an image of the dye on a printing sheet outputted by e.g., a video printer onto a substrate for transcription, such as a cup of pottery or the like. For transcription, a resin is coated on the surface of the substrate for transcription to form a reception layer. This reception layer is dried in an electrical oven to form a support for transcription. A printing sheet carrying an image of a sublimable dye is stacked on the reception layer of the support for transcription and pressured to the reception layer under application of heat and pressure. As the resin for the reception layer, the acrylic resin or the epoxy resin or both are employed. If the resin composed mainly of the acrylic resin is employed, the viscosity of the resin is set to 43 to 52 seconds in terms of the Ford cup viscosity, and the resin discharge pressure from a spray gun is set to 35 $kg/m^2 \pm 0.01$ $kg.cm^2$. The distance between the spray gun and the substrate for transcription is set to 100 mm±5 mm, while the drying temperature is 170 to 180° C. The thickness of the reception layer is 10 to 50 $\mu$m. After transcribing the image of the sublimable dye to the reception layer, a transparent film is bonded, if necessary, as a protective film on the reception layer.

2 Claims, 9 Drawing Sheets

FOREIGN PATENT DOCUMENTS

| | | |
|---|---|---|
| JP | 61-39197 | 9/1986 |
| JP | 62-214990 | 9/1987 |
| JP | 63-10307 | 3/1988 |
| JP | 63-72583 | 4/1988 |
| JP | 63-166737 | 7/1988 |
| JP | 1-208193 | 8/1989 |
| JP | 3-82595 | 4/1991 |
| JP | 3-86588 | 4/1991 |
| JP | 3-70637 | 11/1991 |

* cited by examiner

INK RIBBON FOR IMAGE TRANSCRIPTION

The present application is a div. of the U.S. patent application Ser. No. 08/617,882 filed Oct. 13, 1998 now U.S. Pat. No. 6,417,138 w/c is a 371 of PCT/JP95/01480 filed Jul. 25, 1995.

TECHNICAL FIELD

This invention relates to a method for thermal transcription of an image outputted by a video printer or the like. The present invention also relates to a support for transcription and an ink ribbon employed therefor.

BACKGROUND ART

An image from a video scanner or a video camera, captured into a thermal sublimation type video printer and printed out on a printing sheet, can be handled in a similar manner to a silver salt photograph and a variety of pictures can be easily enjoyed subject to promulgation of such system.

Attempts have also been made for enjoying this system in a manner different from the silver salt photograph. Thus a new article of commerce obtained on transcribing an output image of the video printer on an arbitrary support for transcription, such as a cup of pottery, or a so-called mag-cup, has also been developed. If, in a meeting hall, a still video picture shot by an electronic still camera is transcribed on a mag-cup etc. on the spot, the article would be improved significantly in commercial value.

For transferring an output image of the video printer to a support for transcription, a reception layer is required on the support surface for fixing the dye since the dye cannot be fixed if simply it is attempted to transcribe the dye to the mag-cup surface.

Excellent weatherability is required of the reception layer. To this end, an epoxy based resin has been employed.

The epoxy based resin is a thermosetting resin and, if this resin is coated and printed on e.g., the mag-cup surface, the reception layer excellent in weatherability may be formed.

With the above-described image transcribing method, the properties of the reception layer affects the properties of the picture and hence it has been desired to improve these properties.

If, for example, the reception layer is coated and formed using various resins, the dyeing step is carried out using a hot air drying oven or the like. However, a problem has been raised in connection with discoloration of the reception layer due to e.g., difficulties in controlling the temperature.

On the other hand, if the reception layer is formed of the epoxy-based resin, transcription takes a lot of time.

If a sublimable dye is to be transferred to the mag-cup having the reception layer formed of the epoxy based resin, the transcription time continuing for about three minutes is required for a press working temperature of 170° C.

In case of mass production, the shorter the time of transcription, the more significantly the productivity is improved. However, the time of transcription of three minutes cannot be said to be short. In particular, if a still video image shot with e.g., an electronic still camera is transferred to the mag-cup or the like and sold on the spot, since the processable quantity is governed by the time of transcription, the time of transcription as long as three minutes is extremely undesirable.

On the other hand, although the reception layer formed of e.g., the epoxy based resin, is itself superior in durability and weatherability, the dye transcribed thereon is simply affixed on the reception layer and cannot be said to be sufficient in weatherability such that it is susceptible to color fading or discoloration. In addition, the reception layer is insufficient in resistance against solvents or chemicals, such that the dye image is easily vanished on contact with e.g., an organic solvent.

The reception layer usually has its surface smoothed for improving the transcription efficiency, such that only the surface reflecting an extraneous light is produced. The result is limited usage due to constraint on the appearance and a demand for a variegated appearance laid in case of a building material cannot be met sufficiently.

DISCLOSURE OF THE INVENTION

The present invention is proposed for overcoming the above-described inconvenience.

It is an object of the present invention to provide a method for transcribing a picture whereby a transcribed picture of high quality may be produced.

It is another object of the present invention to provide a method for transcribing a picture and a support for transcription whereby a picture of a sublimable dye can be transcribed in a short time.

It is still another object of the present invention to provide a method for transcribing a picture whereby not only the reflective surface but also a variety of surface states can be realized and a variety of demands in connection with appearance can be met.

The present invention provides an image transcribing method for transcribing an image of a sublimable dye onto a reception layer comprising coating a resin on the surface of a substrate for transcription for forming a reception layer, drying said reception layer in an electrical oven for forming a support for transcription, stacking a printing sheet carrying an image of a sublimable dye on the reception layer of the support for transcription and pressuring said printing sheet onto the reception layer under heat for transcribing the image of the sublimable dye to the reception layer.

By employing an electrical oven for drying the reception layer, precise temperature control becomes possible, such that the reception layer may be prohibited from being discolored and a transcribed image may be produced. Simultaneously, foreign matter may be prohibited from being mixed during drying by a hot air drying oven to prohibit the lowering in the product quality.

If, for coating a reception layer, a cup formed of pottery is employed as a substrate for transcription, the resin is applied by a spray gun as the cup is reversed for forming the reception layer.

In particular, if the resin composed mainly of an acrylic resin, the drying temperature is set to 170 to 180° C., the viscosity of the resin is set to 43 to 52 seconds in terms of the Ford cup density, the discharge pressure of the resin from the spray gun is set to 35 $kg/m^2 \pm 0.01$ $kg/m^2$ and the distance between the spray gun and the substrate for transcription is set to 100 mm±5 mm. The thickness of the reception layer formed as described above is set to 10 to 50 $\mu$m. This enables a uniform reception layer to be formed.

After transcribing the sublimable dye image to the reception layer, a transparent film may be formed on the reception layer.

As the transparent film, an acrylic film, for example, may be employed. The transparent film may contain a UV ray absorber. By embossing the transparent film, a variety of different surface states may be realized.

If, for example, an image of a sublimable dye outputted from a video printer, is transcribed to a support for transcription, the image of the dye is simply deposited on the reception layer formed on the surface of the support for transcription, so that the image is poor in weatherability or resistance against solvents or chemicals and color fading or discoloration is incurred.

By layering and bonding a transparent film such as a film of acrylic resin as a cover coating on the reception layer, the transparent film operates as a protective layer for significantly improving weatherability and resistance against solvents or chemicals.

Although the resin constituting the reception layer is optional, a reception layer composed of the epoxy resin and the acrylic resin is formed on the surface of the substrate for transcription for constituting a support for image transcription.

In this case, the second reception layer composed mainly of the acrylic resin may be layered and formed on the first reception layer mainly composed of the epoxy resin, or alternatively, a reception layer containing both the epoxy resin and the acrylic resin may be formed on the first reception layer.

Although the epoxy resin is superior in durability and weatherability, it is insufficient in transcription speed when used as a reception layer.

Although the acrylic resin is superior in transcription speed, it leaves much to be desired in weatherability.

By simultaneously using the epoxy resin and the acrylic resin, the merits of the two are exploited in a complementing manner for achieving compatibility between the transcription speed and weatherability.

As an ink ribbon for forming an image of the sublimable dye on a printing sheet, an ink ribbon comprised of plural pigment containing layers of different colors arrayed in a pre-set sequence on a strip-shaped substrate, is employed. In this case, it is preferred that a lubricant such as silicon oil be contained in the pigment containing layer printed for the last time or the lubricant containing layer be formed next to the pigment containing layer printed for the last time.

If, in an ink ribbon comprised of plural pigment containing layers of different colors arrayed in a pre-set sequence on a strip-shaped substrate, a lubricant is contained in the pigment containing layer printed for the last time or the lubricant containing layer is formed next to the pigment containing layer printed for the last time, the lubricant contained in the pigment containing layer or in the lubricant containing layer is transferred and deposited to the printing sheet surface when the image is printed by pressuring the ink ribbon against the printing sheet for printing the image.

If the lubricant is deposited in this manner to the printing sheet, lubricity may be accorded to the printing sheet by the lubricant. In addition, when the printing sheet is layered on the support for transcription, such as a mag-cup, air bubbles intruded into the space between the printing sheet and the support for transcription tend to be discharged to outside so that creases are less liable to be produced. Thus a satisfactory image free of non-transcribed portions can be re-transferred to the support for transcription without the necessity of rubbing the printing sheet surface with a spatula.

BEST MODE FOR CARRYING OUT THE INVENTION

Figure 1:
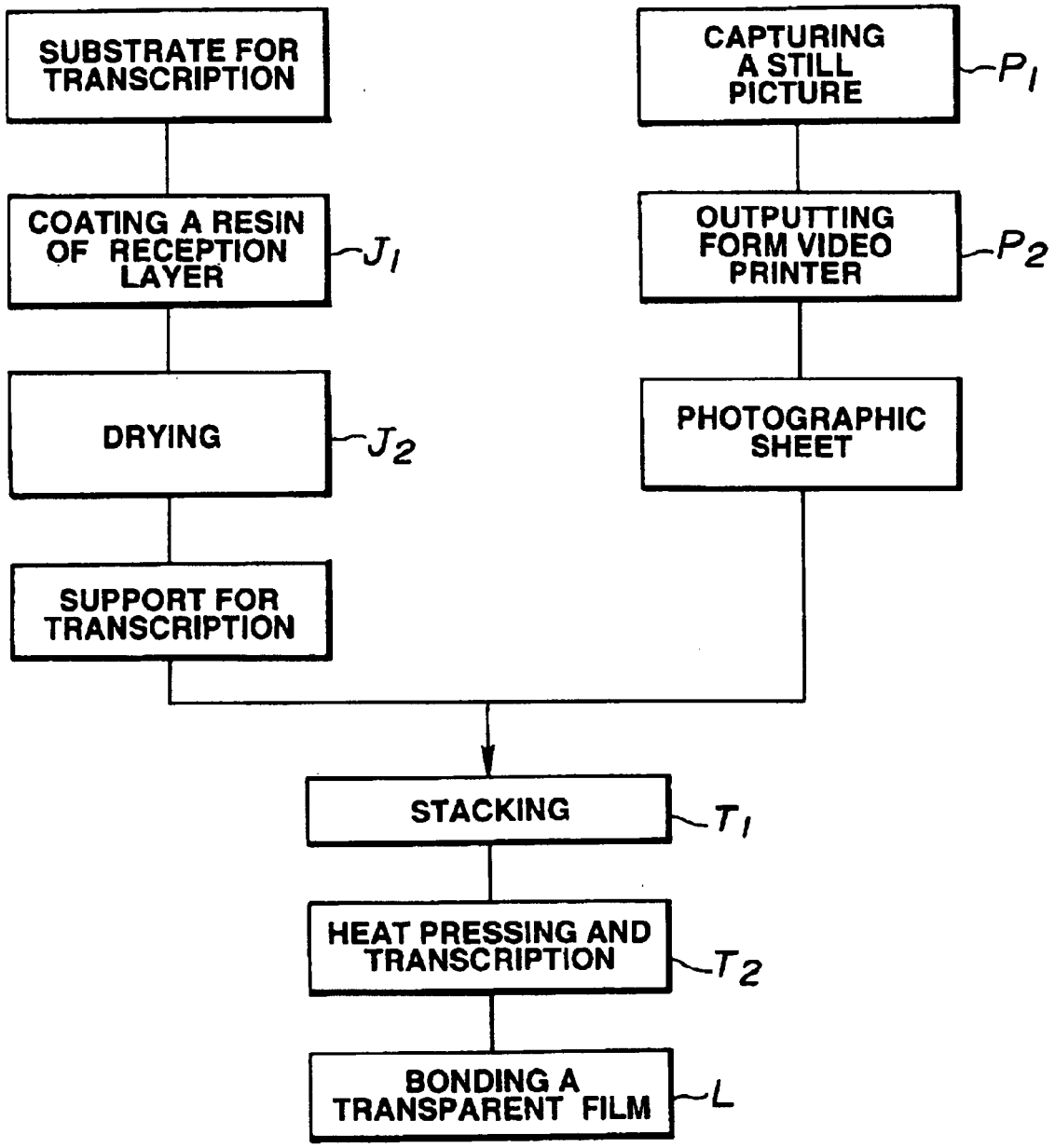
FIG. 1 is a flow chart for illustrating a process sequence in the picture transcribing method according to the present invention.

Referring to FIG. 1, the image transcribing method according to the present invention roughly includes a reception layer forming process, comprised of a step $J_1$ of coating a resin of a reception layer on a substrate for transcription and a step $J_2$ of drying a coated resin in an electric oven to give a support for transcription, a printer outputting step, comprised of a step $P_1$ of capturing a still picture and a step $P_2$ of outputting an image of the sublimable dye to a printing sheet by a video printer, a transcribing process comprised of step $T_1$ of superimposing a printing sheet on the support for transcription and a step $T_2$ of heat-pressing the resulting assembly, and a process of bonding a transparent film comprised of a step L of bonding a transparent film on the surface of the reception layer in case of necessity.

Formation of Reception Layer

Taking an example of employing a special resin composed mainly of acrylic resin, manufactured by MINO NENDO-SHA Co. Ltd. under the trade name of M-11 Type Medume, as the resin for the reception layer, the method of forming a reception layer is explained.

The special resin employed here is mainly composed of an acrylic resin and also contains an extender, an adhesion accelerator and an anti-foaming agent.

Examples of the extender include silica, alumina, alumina silicate, calcium carbonate, mica and quartz powders. Although there is no limitation to the amount of the extender employed provided that it suffices for adjusting flow characteristics of the composition, it is usually 2 to 20 parts by weight and preferably 2 to 4 parts by weight to 100 parts by weight of the acrylic resin.

Examples of the adhesion accelerators include silane coupling agents such as γ-glycidoxypropyl trimethoxy silane, N-β(aminoethyl)-aminopropyl trimethoxy silane, N-β(aminoethyl)-aminopropyl trimethoxy silane or γ-chloropropyl trimethoxy silane. Although there is no limitation to the amount of the adhesion accelerator employed, the usual amount is on the order of 0.05 to 5 parts by weight, preferably 0.07 to 3 parts by weight, to 100 parts by weight of the acrylic resin.

Examples of the anti-foaming agents include known siloxane based anti-foaming agents, such as polyether-modified methylalkyl polysiloxane or polyester modified polydimethyl siloxane. Although there is no limitation to the amount of the anti-foaming agents, it is usually 0.05 to 5 parts by weight and preferably 0.07 to 3 parts by weight to 100 parts by weight of the acrylic resin.

The above special resin is mixed with an organic solvent for dilution, such as xylene, and adjusted to give a viscosity of 43 to 52 seconds, for example, a viscosity of 48 seconds, in terms of the Ford cup viscosity (JIS). If the viscosity of the resin is lower than this range, the reception layer is reduced in thickness and poor in transcription characteristics. Conversely, if the viscosity is too high, the reception layer becomes poor in homogeneity.

After adjusting the mixing ratio in this manner, the special resin is coated on the mag-cup, using e.g., an air-less coater manufactured by NORDSON INC. while the mag-cup is rotated for 0.12 second in the positive direction and then rotated in reverse for 0.29 second.

If the coating time is too long, the coating thickness becomes excessive such that the resin is solidified in a dripping state. Conversely, if the coating time is too short, the reception layer becomes too thin to deteriorate the transcription characteristics.

The purpose of rotating the mag-cup in reverse during coating is to eliminate irregular coating (it is noted that this condition is that for the temperature of 25° C. and the condition is changed with changes in temperature).

The nozzle employed for coating by the air-less coated manufactured by NORDSON INC. is the type #4. Coating cannot be achieved satisfactorily with type #3 nozzle nor with type #5 nozzle.

At this time, the resin discharge pressure from a coating gun is 35 $kg/m^2 \pm 0.01$ $kg/m^2$, while the distance between the coating gun and the substrate for transcription is set to ±5 mm.

After lapse of not less than 180 seconds after coating, drying for not less than 40 minutes is carried out in a drying oven maintained at 170° to 180° C. The drying oven used is an electric oven. If the drying time is too short, the resin is not solidified, whereas, if the drying time is too long, power is wasted, although the properties of the product are not affected by the prolonged drying time.

By carrying out the above processing, the reception layer for re-transcribing an image of the sublimable thermal transfer system on the mag-cup can be formed on the mag-cup to a thickness of 10 to 50 μm. If the thickness of the reception layer is less than 10 μm, the transcribed layer becomes pale in color, whereas, if the thickness of the reception layer exceeds 10 μm, the resin is solidified in the dripping state, thus giving an ill-looking surface appearance.

With the above process, a reception layer is produced which has a surface hardness of 1H in terms of the pencil-scratch strength according to JIS and exhibits acceptable surface whiteness and other states.

There is no limitation to the material of the reception layer such that the epoxy resin and the acrylic resin may be employed in combination. The mode of employing these two resins in combination may be roughly classified into two.

The first mode is to superimpose a layer of an epoxy based resin and a layer of an acrylic resin and the resulting assembly is used as a reception layer.

Although there is no limitation to the number of layers or the layering sequence, it is preferred in view of the transcription efficiency to apply and print the epoxy-based resin on the substrate for transcription and subsequently to coat and print the acrylic resin thereon.

If the above-described layered structure is used, the thickness of the reception layer in its entirety, that is the thickness of the epoxy resin layer plus the thickness of the acrylic resin layer, is preferably 10 to 50 μm, while the thickness of the acrylic resin layer is preferably 10 to 90% and more preferably 10 to 70% of the entire thickness. If the thickness of the acrylic resin layer is too thick or too thin, the merit of employing the resin layer in combination with the epoxy resin layer is lowered.

The second mode is mixing the epoxy resin and the acrylic resin and to coat and print the resulting mixture on the substrate for transcription to give a reception layer.

At this time, the thickness of the reception layer is preferably 10 to 50 μm. On the other hand, the proportion of the acrylic resin contained in the reception layer is preferably 10 to 90 wt % and more preferably 10 to 70 wt %.

If the epoxy resin and the acrylic resin are mixed together in this manner to give a reception layer, resins other than the epoxy resin and the acrylic resin, such as polyester resins etc., may be mixed in the reception layer. In addition, a layer of resins other than the epoxy resin and the acrylic resin, such as polyester resins etc., may be layered on the reception layer.

While any desired substrate for transcription may be used in the present invention, products of pottery, such as a drinking cup formed of pottery, or so-called mag-cup, may be employed. Of course, the present invention may be applied to a variety of tiles or tableware other than mag-cups.

Method for Transcription

Figure 2:
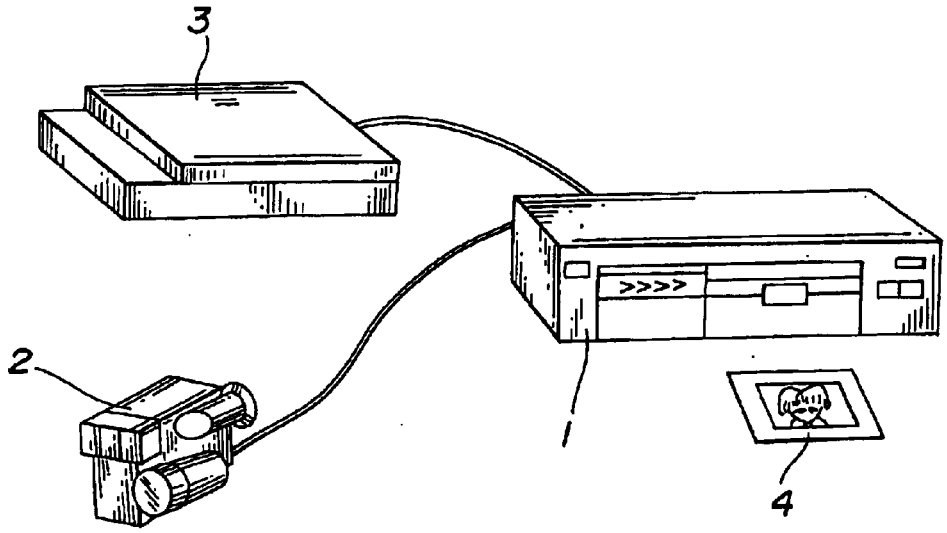
FIG. 2 is a schematic perspective view illustrating an example of an image outputting system by a video printer.

For transcription, a video camera 2 or a video scanner 3 is connected to a video printer of the thermal sublimation system, as shown in FIG. 2. A desired picture is captured and a sublimable dye is transcribed on the printing sheet 4 for printing out the image.

Figure 3:
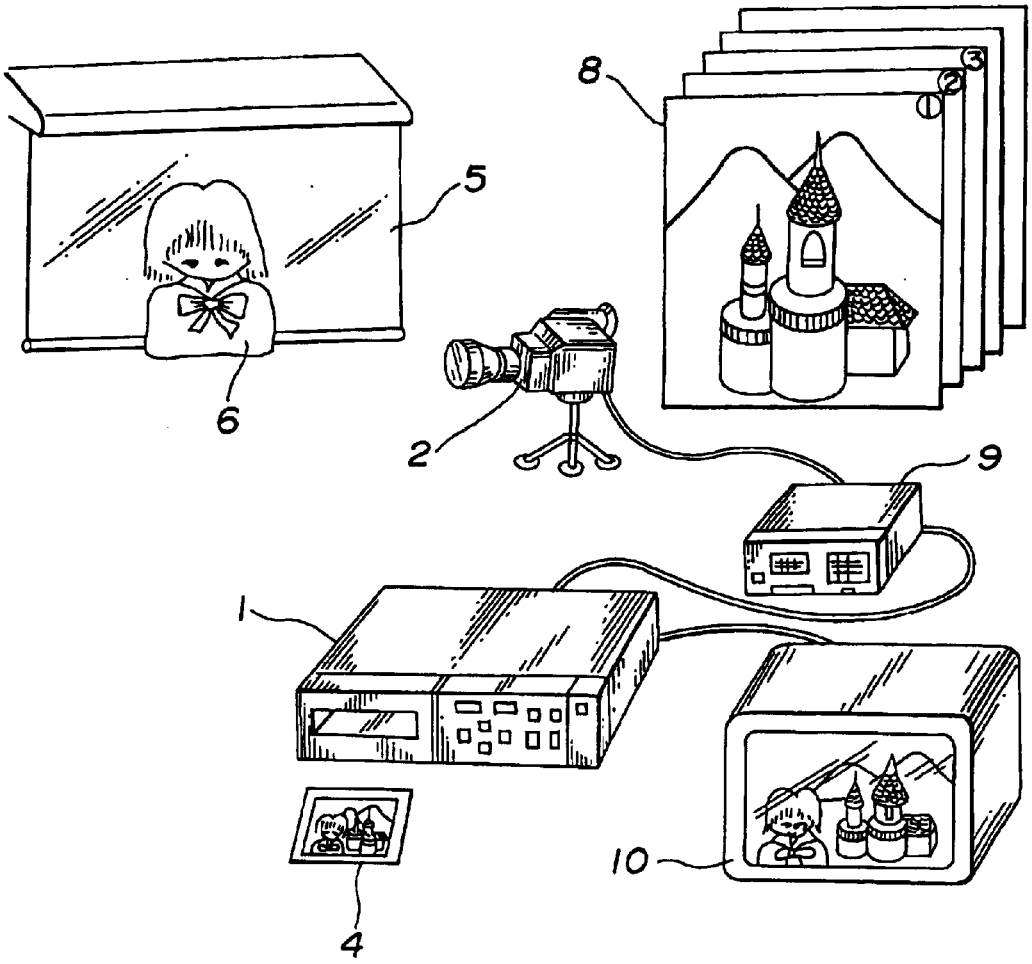
FIG. 3 is a schematic perspective view showing an example of a picture outputting system by superimposition.

FIG. 3 shows a system in which an image of an object and an image of superimposition are synthesized by superimposition to output a resulting image.

That is, with the present system, an object 6 in front of a screen 5 is shot with the video camera 2. A desired one of plural images of superimposition is selected and an image of superimposition 8, as selected as an image for the video camera 2 by a superimposition unit 9, is superimposed an outputted at a video printer 1. An output image is ascertained by a monitor 10 such that a desired image may be printed out on the printing sheet 4.

Figure 4:
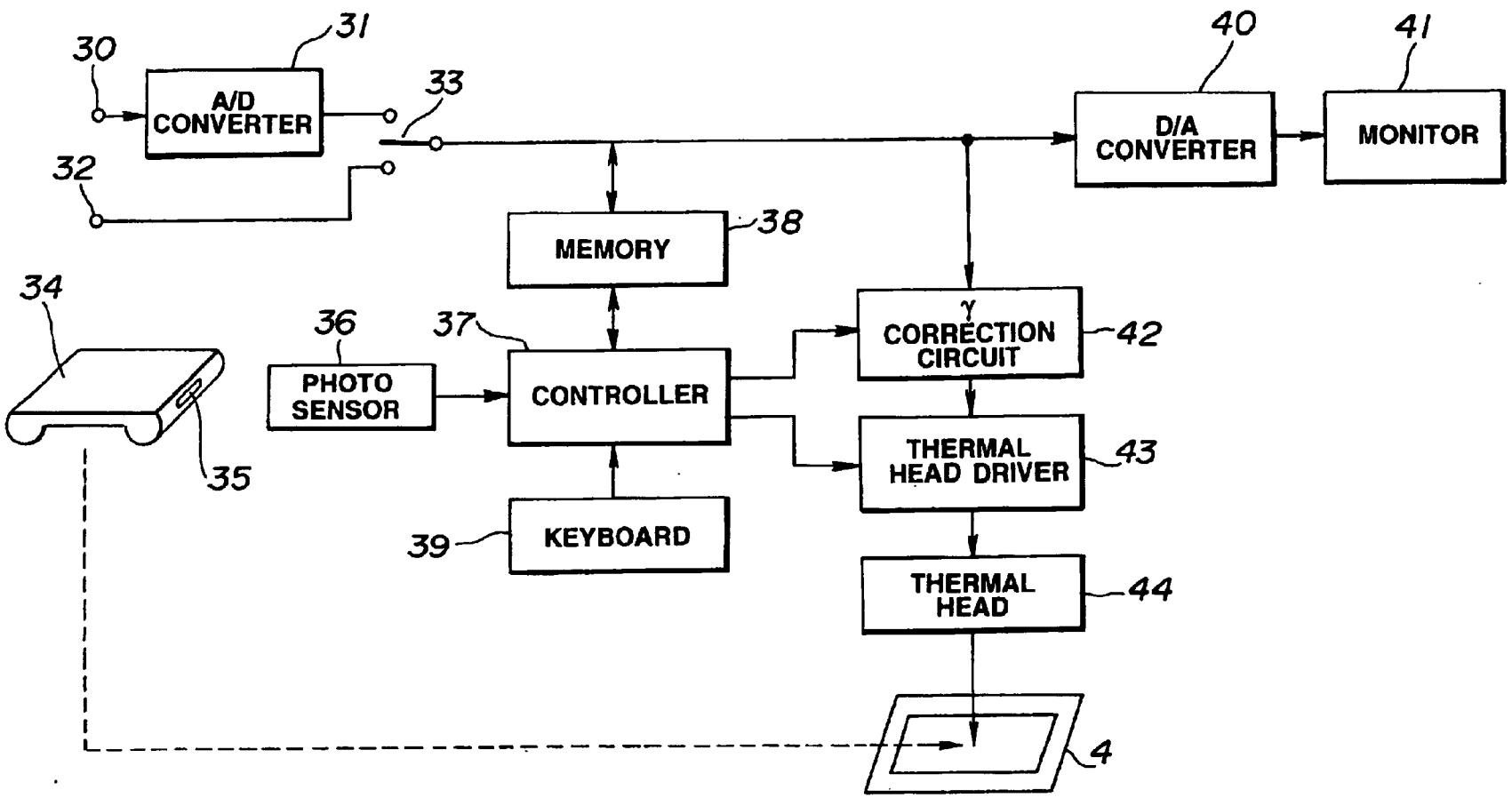
FIG. 4 is a block diagram showing an example of a video printer.

The video printer 4 has the construction as shown in FIG. 4. With the present video printer 1, an analog input signal entering an analog input terminal 30 is converted into digital signals by an A/D converter 31. The digital input signals from the A/D converter 31 are supplied to one of the contacts of a switching unit 33. A digital input signal supplied to a digital input terminal 32 is supplied to the other contact of the switching unit 33.

An analog input signal or a digital input signal is supplied from a video camera to the analog input terminal 30 or to the digital input terminal 32.

A color heat-transfer ink ribbon 34 has a reflector 35 on its lateral surface for reflecting the light. In association therewith, a reflection type photosensor 36 having a light projecting portion and a light receiving portion is provided on a video printer.

When the color heat-transfer ink ribbon 34 is loaded on the video printer, the photosensor 36 projects light from the light projecting portion thereof onto the reflector 35 and receives the light reflected back from the reflector 35 at the light receiving portion thereof.

This turns on the photosensor 36 which then transmits data advising to the controller 37 of the effect that the color heat-transfer ink ribbon 34 and the printing sheet 4 operate as media for transcription. If the color heat-transfer ink ribbon 34 and the printing sheet 4 are media other than those for transcription printing, no reflector 35 is provided on the lateral surface of the color heat-transfer ink ribbon 34, so that the photosensor 36 is maintained in the off-state thus enabling the medium to be identified as a medium other than the medium for transcription printing.

A memory 38 stores the digital input signal as selected by the switching unit 33 and reads it out at a pre-set timing.

A controller 37 controls the heat-transcription printer and is constituted by a CPU. The controller 37 reads out data from the memory 38 and converts digital signals by a D/A converter 40 into analog signals which are sent to a monitor 41.

The monitor 41 displays the input signal by an image and a superimposed letter information in order to permit the user to visually inspect whether or not the signal needs left/right inversion.

A keyboard 39 is connected to the controller 37 for entering instructions of whether or not the digital input signal as discerned by the monitor 41 is a signal in need of left/right inversion.

The controller 37 controls the operation of correction of a γ-correction circuit 42, based upon the discrimination data as to whether or not the data from the photosensor 36 indicates the medium for transcription printing and input data as to whether or not the input signal from the keyboard 39 is a signal in need of left-right reversal.

When effecting printing on the printing sheet 4 under application of a pressure of the heat-transcription ink ribbon 34 against a thermal head under heating, the γ-correction circuit 42 effects γ-correction for optimizing the concentration of the transferred image. This γ-correction is carried out in such a manner as not to affect coloration characteristics of the media for transcription printing made up of the color heat-transcription ink ribbon 34 and the printing sheet 4. In the preset case, characteristics of the γ-correction are changed depending upon whether the color heat-transcription ink ribbon 34 and the printing sheet 4 are the media for heat-transcription printing or media other than those for transcription printing, and also upon whether or not the input signal is a signal in need of left/right reversal.

After γ correction performed by the γ-correction circuit 42 in a manner suitable for the printing medium, the digital input signal is fed to a thermal head 44 via a thermal had driver 43. The thermal head 44 heats a color heat-transcription ink ribbon 34 for printing an image on the printing sheet 4.

Figure 5:
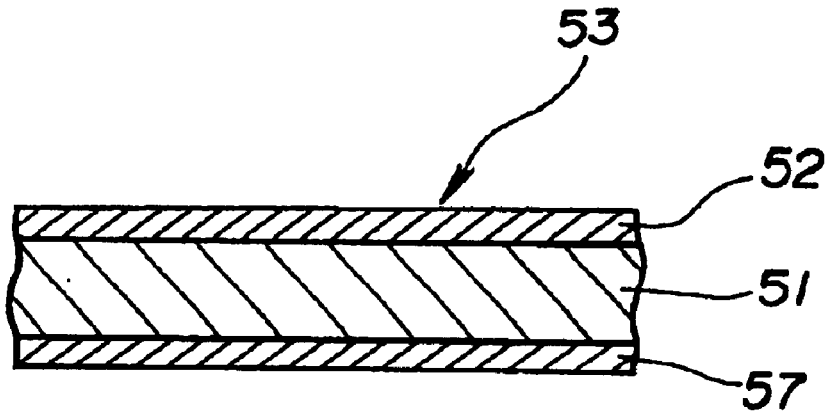
FIG. 5 is a cross-sectional view showing an illustrative construction of an ink ribbon.

Although the ink ribbon employed for the video printer 1 is optional, such an ink ribbon may be employed in which, as shown in FIG. 5, plural pigment-containing layers with different coloration 52 are formed in parallel in a pre-set sequence on a strip-shaped substrate 51 and in which a lubricant is contained in the pigment-containing layer printed for the last time, for thereby improving transcription characteristics.

Figure 6:
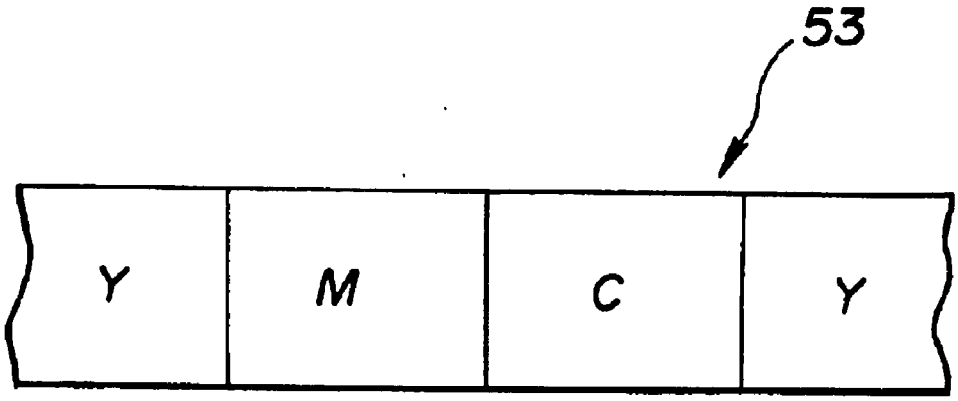
FIG. 6 is a plan view of the ink ribbon shown in FIG. 5.

The pigment-containing layers 52 are comprised of pigments, such as yellow, magenta or cyan, contained in optional resin materials. For example, yellow pigment containing layers Y, magenta pigment containing layers M and cyan pigment containing layers C are repeatedly arrayed in this order in parallel on the strip-shaped substrate 51, as shown in FIG. 6. With the present ink ribbon, a lubricant for smoothing the surface of the printing sheet is contained in the cyan-color pigment containing layer C, which is printed last among the three pigment-containing layers.

That is, with the present ink ribbon 53, the pigment containing layers Y, M and C ate stacked on the printing sheet in the arraying sequence and the pigment-containing layers and the printing sheet are partially heated and pressured for printing an image so that he yellow pigment, magenta pigment or the cyan pigment will be transcribed on required portions on the printing sheet in accordance with the image information captured into the video printer.

Figure 7:
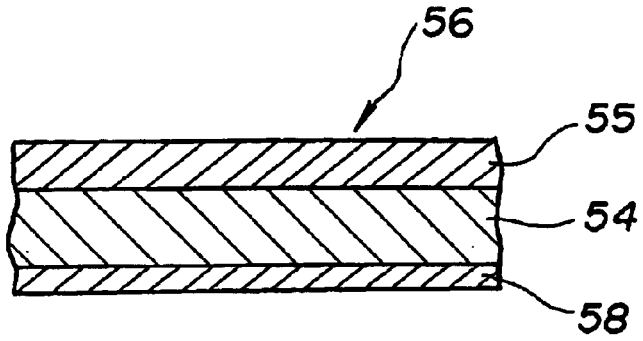
FIG. 7 is a cross-sectional view of a printing sheet on which a picture is printed by the ink ribbon.

On the other hand, a printing sheet 56, on which an image is transcribed by this ink ribbon 53, is comprised of a substrate 54 and a reception layer 55 into which the pigments are transcribed, as shown in FIG. 7.

Figure 8:
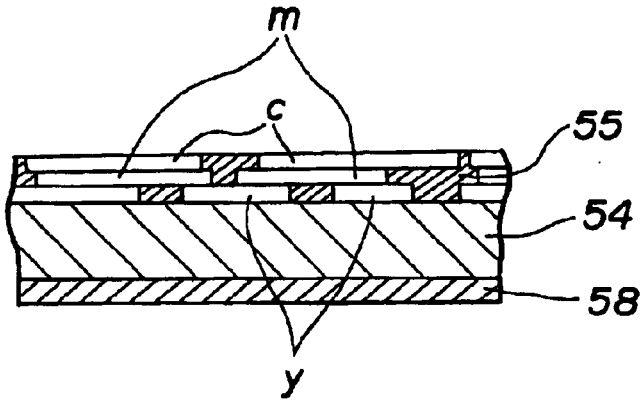
FIG. 8 is a cross-sectional view showing the state in which the dye has been transcribed to the printing sheet.

On heating and pressuring the printing sheet 56 and the pigment-containing layers of the ink ribbon 53, the respective pigments y. m and c from the pigment-containing layers are transcribed in superimposition on the reception layer 55, as shown in FIG. 8.

If now a lubricant is contained in the cyan pigment containing layer C, printed for the last time, when the cyan pigment containing layer C is stacked on the printing sheer 56 and pressured under heating, the lubricant contained in the cyan containing layer C is transferred and deposited to the surface of the printing sheet 56 for imparting lubricity to the surface of the printing sheet 56.

With the printing sheet 56, to which lubricity has been imparted as described above, air bubbles entering the space between the printing sheet 56 and the support for transcription during the time the sheet 56 is superimposed on a support for transcription, such as mag-cup, for re-transferring the image, are liable to be discharged to outside, while creases are less liable to be produced. Thus an image of an excellent quality free of non-transcribed portions may be re-transcribed on the support for transcription.

Although it may be contemplated to directly apply a lubricant on the surface of the printing sheet or the surface of the support for transcription, the number of steps is increased, while the operator's hand may be contaminated with the lubricant. With the present invention, the above-described advantages may be derived while avoiding such inconvenience, so that the method may be said to be highly meritorious.

As the lubricant, those commonly employed without affecting pigment transcription or coloration are selected.

For example, silicon oil is suitable. In addition, higher fatty acids, such as myristic acid, palmitic acid, stearic acid or oleic acid, metal or amine salts thereof, esters of fatty acids and alcohols, alkyl-phosphoric acid ester, perfluoro polyether and modified products thereof, may be employed.

For protecting the substrates from heat devolved by the thermal head, it is possible to provide a protective layer 57 on the side of the ink ribbon 55 opposite to the pigment containing layer 52, while it is also possible to provide a protective layer 58 on the side of the printing sheet 56 opposite to the reception layer 55.

Figure 9:
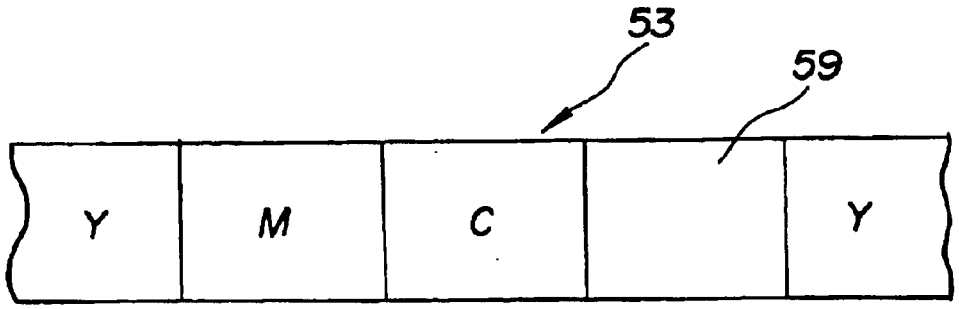
FIG. 9 is a plan view showing another illustrative construction of an ink ribbon.

As for the ink ribbon, a lubricant containing layer 59 may also be formed next to the last-printed pigment containing layer, herein the cyan containing layer C, separately from the pigment containing layer, in place of containing the lubricant in the last-printed pigment-containing layer, as shown in FIG. 9.

With the ink ribbon 53, provided with the lubricant-containing layer 59, a yellow-pigment containing layer Y, a magenta pigment containing layer M and a cyan pigment containing layer C are layered in this order on the printing sheet and pressured under heat application. Finally, the lubricant-containing layer 59 is layered on the printing sheet and pressured under heat application. The lubricant contained in the lubricant containing layer 59 is transferred to and deposited on the surface of the printing sheet 56 for imparting lubricity to the surface of the printing sheet 56. If the lubricant is contained in the pigment-containing layer, it is feared that variation may be produced to more or less extent in the amount of the lubricant transferred to the printing sheet 56, because pressuring and heating are local depending on the image information. If the lubricant containing layer 59 is provided in this manner, pressuring and heating may be applied uniformly on the entire surface, thus enabling the lubricant to be smoothly transferred to the printing sheet.

The lubricant contained in the lubricant containing layer 59 is selected in accordance with the same guideline as described above so that silicon oil is again most preferred.

Figure 10:
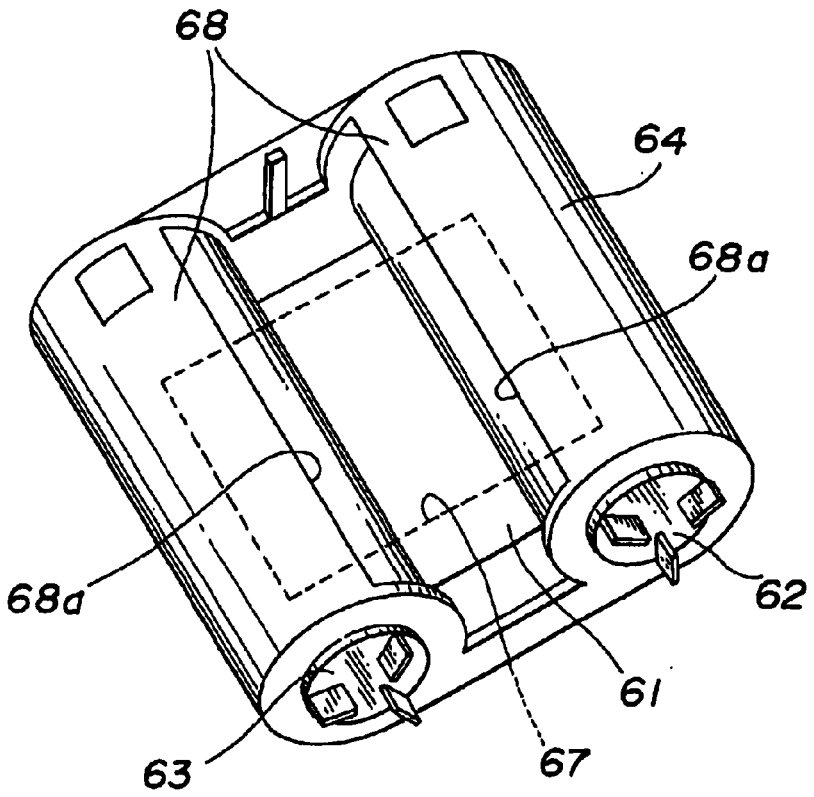
FIG. 10 is a schematic cross-sectional view showing an ink ribbon cassette and an ink ribbon assembled therein.

The ink ribbon is enclosed in a silicon cassette and handled in this state. The ink ribbon cassette has a pay-out reel 62 and a take-up reel 63, on which an ink ribbon 61 is wound and which are built in a cassette shell 64, as shown in FIG. 10.

Figure 11:
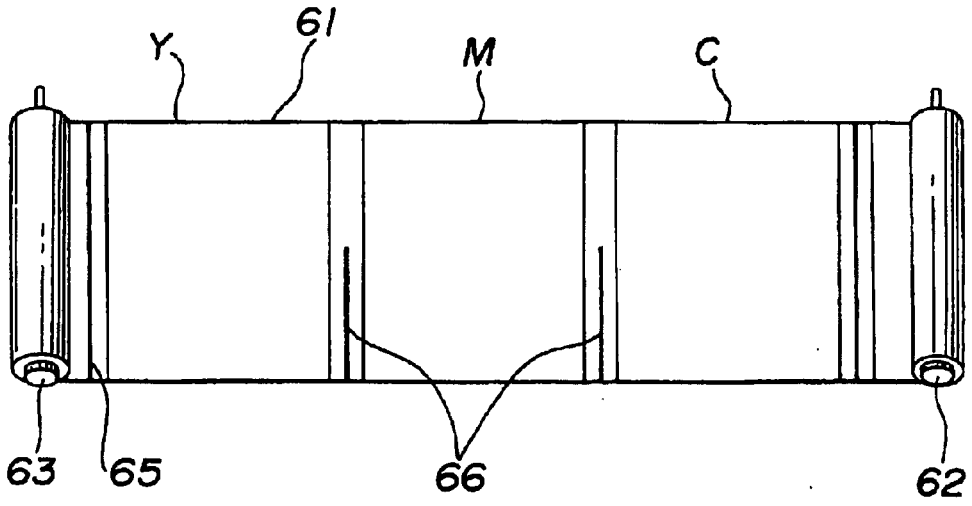
FIG. 11 is a plan view showing an ink ribbon assembled into an ink ribbon cassette.
Figure 12:
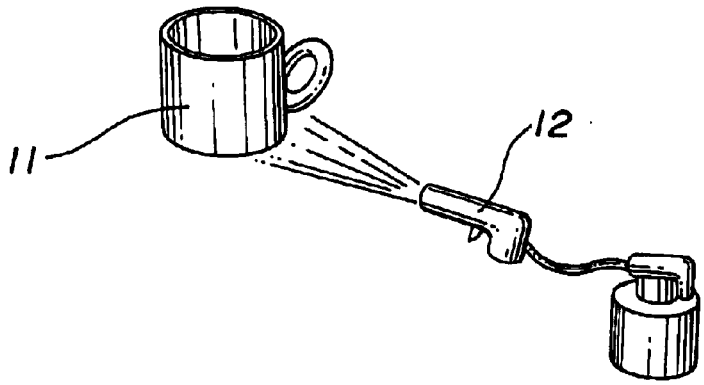
FIG. 12 is a schematic perspective view showing a spray coating step for a reception layer.

The ink ribbon 61 is comprised of sublimable yellow, magenta and cyan pigments contained in optional resins and arranged on a strip-shaped substrate. The yellow pigment containing layer Y, magenta pigment-containing layer M and the cyan pigment containing layer C are repeatedly formed in parallel on the ink ribbon, as shown in FIG. 11. Silicon oil is contained in the cyan pigment containing layer C which is printed for the last time among the three pigment containing layers. With the present ink ribbon 61, a ribbon head locating mark 65 is provided directly before the first-printed yellow pigment containing layer Y, while color locating marks 66 are accorded between the yellow pigment containing layer Y and the magenta pigment containing layer M and between the magenta pigment containing layer M and the cyan pigment containing layer C.

As for the cassette shell 64, a pair of substantially cylindrically-shaped reel-containing portions 68 are provided on both ends of a plate having a window 67. The reel-containing portions 68 are formed on opposite side thereof with slits 68 a via which is passed the ink ribbon 61. The pay-out reel 62 and the take-up reel 63, about which the ink ribbon 61 is wound, are accommodated in the reel-containing portions 68 in a direction of exposing the pigment-containing layer of the ink ribbon 61 via the window of the cassette shell 64.

The ink ribbon 61, built into the cassette shell 64, is run with the ribbon head locating mark 65 as an index, until the firstly located yellow pigment containing layer Y is exposed via the entire surface of the window 67 of the cassette shell. The yellow pigment containing layer Y thus exposed via the window 67 and the printing sheet set in register with the window 67 are stacked together and a thermal head is applied to the back surface of the ink ribbon 61 for thermally transferring the yellow pigment of the yellow pigment containing layer Y onto required portions of the printing sheet.

After transcription of the yellow pigment in this manner, the ink ribbon 61 is run, so as to be stacked on the printing sheet, with the color locating mark 66 as an index, until the secondly located magenta pigment containing layer M is exposed via the window in its entirety. The magenta pigment of the magenta pigment-containing layer M is thermally transcribed on a required area of the printing sheet by the thermal head.

Finally, the ink ribbon 61 is run, with the color locating mark 66 as an index, until the thirdly located cyan pigment containing layer C is exposed via the window 67 in its entirety so as to be stacked on the printing sheet. The cyan pigment of the cyan pigment containing layer C is thermally transcribed on a required area of the printing sheet by the thermal head for completing the image.

Since the silicon oil is contained in the cyan pigment containing layer C of the present ink ribbon 61, the silicon oil, contained in the cyan pigment containing layer C, is transferred to the printing sheet at the time of thermal transfer of the cyan pigment containing C for according lubricity to the printing sheet surface.

On the surface of the mag-cup 11, as a substrate for transcription, a mixture of epoxy resin and acrylic resin, previously prepared by mixing using a spray gun 12, is coated and printed for forming a reception layer.

Alternatively, the epoxy resin may be coated by the spray gun 12 on the surface of the mag-cup 11 and printed, after which the acrylic resin is coated by the spray gun 12 and printed for providing a reception layer comprised of a dual structure of the epoxy-based resin layer and an acrylic-based resin layer.

Figure 13:
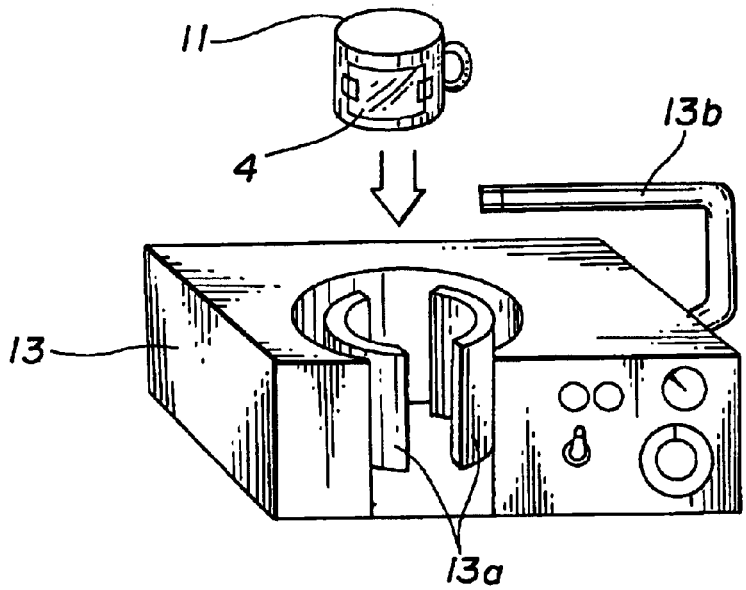
FIG. 13 is a schematic perspective view showing a step of transcription by a heat press.

As shown in FIG. 13, the printed-out printing sheet 4 is bonded on the surface of the mag-cup 11, so that the image 4 produced by the sublimable dye is stacked in register with the reception layer. The resulting assembly is pressured under heating by a thermal press 13, manufactured by EXPRESS INC. under the trade name Mag-Press 300X, for transcribing the sublimable dye.

The thermal press 13 has a mag-cup support 13*a* having the shape of a half cylinder in conformity to the shape of the outer periphery of the mag-cup 11. The mag-cup support 18*a* is pressured against the mag-cup 11 on actuation of an operating lever 13*b*. The mag-cup support 13*a* also has a heating unit whereby it may be heated to a desired temperature. The thermal press 13 also has a timer for optionally setting the time of heating and pressuring by the mag-cup support 13*a*.

If the mag-cup 11 is loaded on the thermal press 13 and the pre-set pressure and heat are applied, the sublimable dye on the printing sheet 4 is transferred by the pressure and heat to the reception layer on the surface of the mag-cup surface 11.

Researches into Reception Layer

Figure 15:
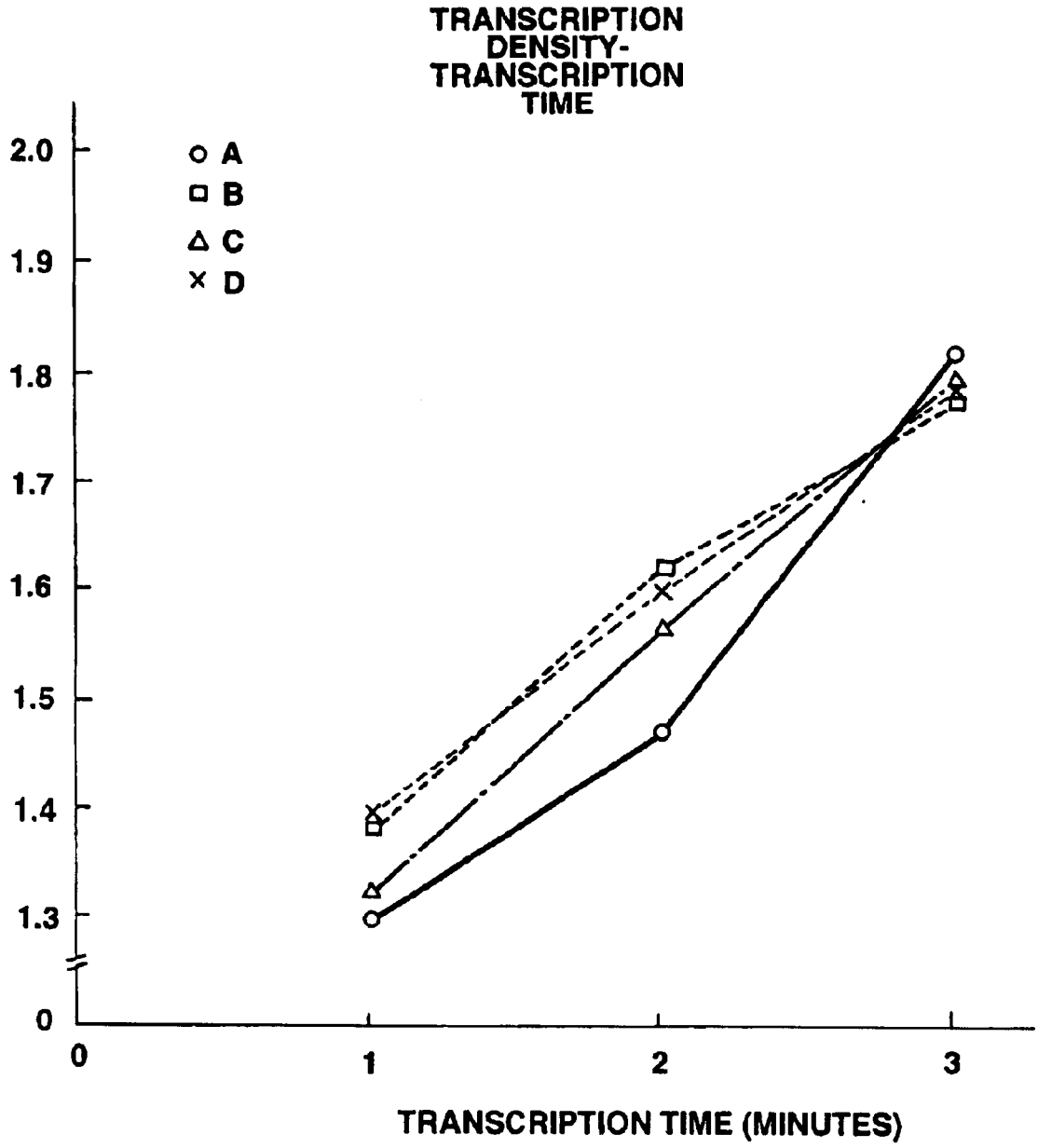
FIG. 15 is a graph showing the relation between the time o transcription in a variety of reception layers and the concentration of transcription.
Figure 16:
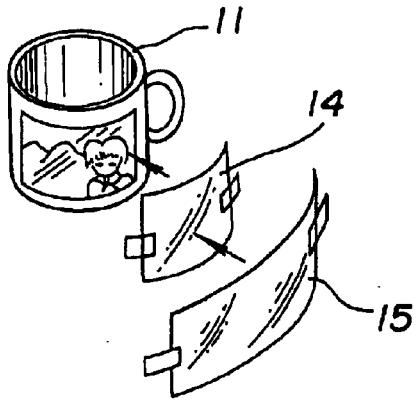
FIG. 16 is a schematic perspective view showing the step of thermally fusing a transparent film.

The following four sorts of the reception layers were formed on the mag-cup in order to check the transcription efficiency. The transcription efficiency was evaluated based upon the concentration of transcription and the transcription time. The following reception layers were formed. Table 1 and FIG. 15 illustrate the results of measurement of the transcription efficiency.

Reception layer A: epoxy resin

Reception layer B: epoxy resin plus acrylic resin layer (two-layered coating)

Reception layer C: mixed layer of epoxy resin and acrylic resin (epoxy resin:acrylic resin ratio=5:5).

The epoxy resin employed was EP-4100 manufactured by ASAHI DENKA KOGYO SHA under the product number. The thickness of each reception layer was approximately 30 μm, with the exception of the reception layer B made up of the epoxy resin layer of 15 μm and the acrylic resin layer of 15 μm.

TABLE 1

| | 1.5 min × 2 | 1 min × 2 | 0.5 min × 2 |
|---|---|---|---|
| reception layer A | 1.81 | 1.48 | 1.30 |
| reception layer B | 1.77 | 1.62 | 1.39 |
| reception layer C | 1.79 | 1.57 | 1.33 |
| reception layer D | 1.78 | 1.60 | 1.40 |

It is seen from Table 1 and FIG. 15 that the transcription efficiency is improved with the use of the acrylic resin for the reception layer (reception layers B, C and D), such that, even with the pressurizing and heating for two minutes, transcription proceeds sufficiently as evidenced by the transcription concentration of not less than 1.55 in terms of $D_{MAX}$ as measured with a Macbeth densitometer. Conversely, with the reception layer A in which only the epoxy resin is used, the transcription concentration falls short with heating and pressuring for two minutes, while sufficient transcription is achieved only with heating and pressuring continuing for longer than three minutes.

The respective reception layers were also checked as to weatherability. For checking weatherability, the mag-cup was crushed to suitable size and ultrasonically washed for ten minutes in pure water and in 99% ethanol for 10 minutes. The mag-cup was then directly immersed in ethanol for one hour and changes in the reception layer were checked. The results are shown in Table 2.

TABLE 2

| | |
|---|---|
| reception layer A | cannot be peeled except by using a cutter knife |
| reception layer B | fine chips are produced on rubbing with a cutter knife |
| reception layer C | slightly viscous and cannot be peeled off except by scraping off using a cutter knife |
| reception layer D | creases and peeling occurred locally |

If only the acrylic resin is employed, as in the case of the reception layer D, creases and peeling occurred, and weatherability fell short. Conversely, with the use of the epoxy resin, changes after the test are small an sufficient weatherability is assured.

It is seen from the above results of analyses that, for assuring both transfer speed and weatherability, it is necessary to employ the epoxy resin and the acrylic resin in combination.

Bonding the Transparent Film

After transcription of the image as described above, a transparent film may be bonded to the surface of the reception layer. In such case, an acrylic resin film having a thickness of 5 to 100 μm, preferably 5 to 20 μm, may be employed.

Figure 14:
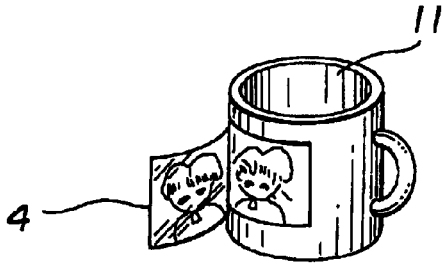
FIG. 14 is a schematic perspective view showing the state in which the sublimable dye image has been transferred.

The transparent film 14 is bonded to the reception layer as shown in FIG. 14 and bonded thereto under application of heat and pressure. In the present Example, an acrylic film containing UV ray absorber, manufactured by KANEGAFUCHI KAGAKU KOGYO CO. LTD. was used as the transparent film 14 and thermally fused in position at approximately 140° C. for two seconds.

For thermally fusing the transparent film 14, the film 14 is bonded on the image of the sublimable dye transcribed on the surface of the mag-cup 11. For prohibiting the dye from being transferred back to the press used for thermal fusion, a re-transfer prohibiting sheet 15 is preferably stacked on the transparent film 14.

The mag-cup, thus prepared, with the image transcribed thereon, is significantly improved in weatherability and resistance against solvents and chemicals and is safeguarded against fading or discoloration due to UV rays. There is also no risk of fading or discoloration on washing with a detergent.

Although the surface of the mag-cup 11 is smoothed for improving the transcription efficiency of the image of the sublimable dye, the surface of the transparent film 14 may be embossed by using an embossed re-transfer prohibiting sheet 15.

Figure 17:
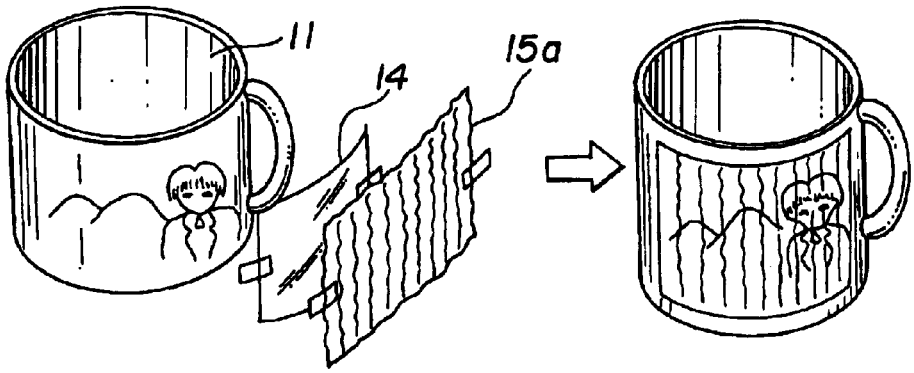
FIG. 17 is a schematic perspective view showing the formation of the support for image transcription with the aid of a re-transcription preventative sheet having a crimped pattern formed thereon.
Figure 18:
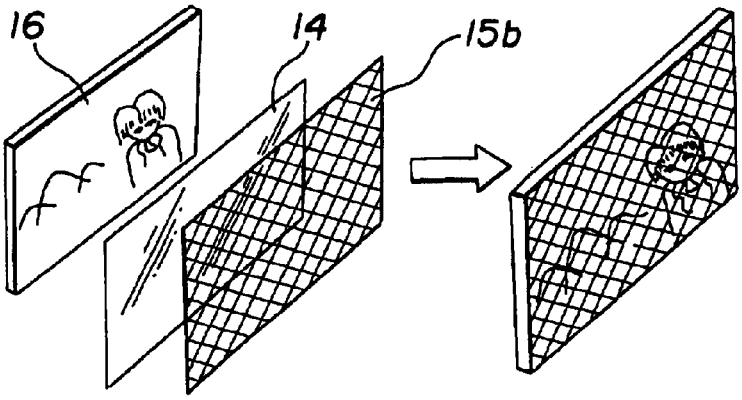
FIG. 18 is a schematic perspective view showing the formation of the support for image transcription with the aid of a re-transcription preventative sheet having a meshed pattern formed thereon.

If a support for image transcription having a crease pattern is formed on the mag-cup 11 as shown in FIG. 17, it is sufficient if a re-transcription prohibitive sheet 15*a* having an embossed pattern corresponding to the desired creased pattern is used and the transparent film 14 is thermally fused via this sheet 15*a*. If it is desired to form a support for image transcription having a meshed pattern on a tile 16, as shown in FIG. 18, it is sufficient if a re-transcription prohibitive sheet 15*a* having an embossed pattern corresponding to the desired meshed pattern is used and the transparent film 14 is thermally fused via this sheet 15*a*.

What is claimed is:

1. An ink ribbon for image transcription having plural pigment-containing layers with different colors formed on a strip-shaped substrate in a predetermined order, characterized in that a lubricant is contained in the last-printed pigment containing layer, the lubricant being selected from a group of lubricants consisting of silicon oil, higher fatty acids, metal or amine salts of the higher fatty acids, esters of fatty acids and alcohols, alkylphosphoric acid ester and perfluoro polyether.

2. An ink ribbon for image transcription as claimed in claim 1, wherein the higher fatty acids include at least one of myristic acid, palmitic acid, stearic acid and oleic acids.

* * * * *